US012509843B1

(12) United States Patent
Cao et al.

(10) Patent No.: US 12,509,843 B1
(45) **Date of Patent: *Dec. 30, 2025**

(54) TRANSMISSION LINE TOWER BASE WITH ELECTROTHERMAL AIR-BLOWING ANTI-FROST HEAVE FUNCTION FOR PERMAFROST REGIONS

(71) Applicant: NORTHWEST INSTITUTE OF ECO-ENVIRONMENT AND RESOURCES, CAS, Gansu (CN)

(72) Inventors: Yapeng Cao, Lanzhou (CN); Guoyu Li, Lanzhou (CN); Dun Chen, Lanzhou (CN); Wei Ma, Lanzhou (CN); Yanhu Mu, Lanzhou (CN); Yunhu Shang, Lanzhou (CN); Kai Gao, Lanzhou (CN); Shunshun Qi, Lanzhou (CN)

(73) Assignee: NORTHWEST INSTITUTE OF ECO-ENVIRONMENT AND RESOURCES, CAS, Lanzhou (CN)

( * ) Notice: Subject to any disclaimer, the term of this patent is extended or adjusted under 35 U.S.C. 154(b) by 0 days.

This patent is subject to a terminal disclaimer.

(21) Appl. No.: 19/251,746

(22) Filed: Jun. 26, 2025

(30) Foreign Application Priority Data

Oct. 18, 2024 (CN) ..... 202411456127.4

(51) Int. Cl.
*E02D 5/28* (2006.01)
*E02D 27/42* (2006.01)
*E02D 31/14* (2006.01)

(52) U.S. Cl.
CPC ..... *E02D 31/14* (2013.01); *E02D 27/42* (2013.01)

(58) Field of Classification Search
CPC ..... E02D 31/14; E02D 27/42; E02D 5/22; E02D 27/12; E02D 27/35; E02D 3/115; E02D 5/28
See application file for complete search history.

(56) References Cited

U.S. PATENT DOCUMENTS 3,636,725 A * 1/1972 MacCracken ..... F25C 3/02 62/235
3,731,392 A * 5/1973 Gottfried ..... A23L 2/14 34/291

(Continued)

FOREIGN PATENT DOCUMENTS

CN 212534055 U 2/2021
CN 112797263 A 5/2021

(Continued)

OTHER PUBLICATIONS

Notification to Grant Patent Right for Invention in Chinese Application No. 202411456127.4 mailed on Nov. 28, 2024, 7 pages.

*Primary Examiner* — Edwin J Toledo-Duran
(74) *Attorney, Agent, or Firm* — PORUS IP LLC

(57) ABSTRACT

The embodiment of the present disclosure provides a transmission line tower base with electrothermal air-blowing anti-frost heave functions for permafrost regions. The transmission line tower base includes a pile foundation cylinder, a cylinder top seat, a cylinder base, a transmission line tower connection frame, a support column inside the pile foundation cylinder, arcuate tubes, heating rods, and a top air-blowing device. The cylinder top seat is fixedly provided at a top of the pile foundation cylinder, and the transmission line tower connection frame is fixedly mounted on the cylinder top seat for connecting to a bottom foot of a transmission line tower body. The cylinder base is provided at a bottom of the pile foundation cylinder. The pile foundation cylinder includes a hollow installation cavity, and the support column is embedded in the installation cavity.

8 Claims, 10 Drawing Sheets

(56) References Cited

U.S. PATENT DOCUMENTS 3,749,162 A * 7/1973 Anders ..... E21B 7/12 114/40
3,791,443 A * 2/1974 Burt ..... E02D 27/35 165/45
4,067,198 A * 1/1978 Long ..... E02D 3/115 405/234
4,089,142 A * 5/1978 Kachadorian ..... E02D 31/00 126/400
4,205,718 A * 6/1980 Balch ..... F24D 11/0235 126/400
4,302,291 A * 11/1981 Severs ..... G21C 13/00 405/195.1
4,397,586 A * 8/1983 Weiss ..... E02B 17/0017 405/211
4,590,348 A * 5/1986 Lahti ..... E02D 3/11 219/710
4,620,398 A * 11/1986 Wallin ..... E02D 27/00 52/169.1
4,843,786 A * 7/1989 Walkinshaw ..... E02D 31/008 454/251
4,905,579 A * 3/1990 Dame ..... E02D 31/008 250/DIG. 2
5,158,501 A * 10/1992 Proskiw ..... E02D 31/008 454/341
5,327,734 A * 7/1994 Haynes ..... E02D 3/115 62/DIG. 22
5,836,815 A * 11/1998 Jennemann ..... E02D 31/008 454/341
6,904,723 B1 * 6/2005 Moore ..... E02D 31/02 454/341
8,207,479 B2 * 6/2012 Ben-Shmuel ..... H05B 6/666 219/746
8,389,916 B2 * 3/2013 Ben-Shmuel ..... H05B 6/688 219/748
11,519,618 B1 * 12/2022 White ..... F24F 7/04
11,808,462 B1 * 11/2023 Castelle ..... F24V 99/00
2004/0155028 A1 * 8/2004 Doyle ..... F24F 11/0001 219/535
2008/0072511 A1 * 3/2008 Phuly ..... E02D 27/28 52/294
2010/0200192 A1 * 8/2010 Consigny ..... F24T 10/17 165/45
2010/0305918 A1 * 12/2010 Udell ..... F24T 10/40 703/2
2011/0061321 A1 * 3/2011 Phuly ..... F03D 13/22 52/297
2012/0047830 A1 * 3/2012 Phuly ..... E02B 17/025 52/294
2012/0291380 A1 * 11/2012 Tooman ..... E02D 27/425 52/742.16
2013/0142677 A1 * 6/2013 Snyder ..... F04C 2/16 417/313
2015/0041598 A1 * 2/2015 Nugent ..... B64B 1/50 244/53 R
2015/0108764 A1 * 4/2015 Moeller ..... F03D 80/00 290/55
2015/0225918 A1 * 8/2015 Phuly ..... E02D 27/26 52/297
2015/0376859 A1 * 12/2015 Phuly ..... E04H 12/341 52/294
2016/0231011 A1 * 8/2016 Ankeny ..... F24F 5/0046
2018/0031337 A1 * 2/2018 Guarrero ..... H01B 1/18
2018/0264680 A1 * 9/2018 Phuly ..... F03D 13/20
2018/0339259 A1 * 11/2018 Hallberg ..... G21F 1/00
2020/0064028 A1 * 2/2020 Warren ..... F28D 1/0226
2021/0098143 A1 * 4/2021 Trojer ..... G21C 5/10
2021/0222427 A1 * 7/2021 Ma ..... E04H 12/00
2022/0389677 A1 * 12/2022 DiCello ..... E04B 1/7069

FOREIGN PATENT DOCUMENTS

CN 114438994 A 5/2022
CN 116335207 A 6/2023
CN 116556321 A 8/2023
CN 219548553 U 8/2023
CN 118065415 A 5/2024

* cited by examiner

TRANSMISSION LINE TOWER BASE WITH ELECTROTHERMAL AIR-BLOWING ANTI-FROST HEAVE FUNCTION FOR PERMAFROST REGIONS

CROSS-REFERENCE TO RELATED APPLICATIONS

This application claims priority to Chinese Patent Application NO. 202411456127.4, filed on Oct. 18, 2024, the contents of which are hereby incorporated by reference.

TECHNICAL FIELD

The present disclosure relates to the technical field of transmission line tower support, and in particular relates to a transmission line tower base with electrothermal air-blowing anti-frost heave functions for permafrost regions.

BACKGROUND

Permafrost is also known as frozen ground, tundra, or taiga. The permafrost in physical geography refers to an environment where trees cannot grow due to low temperatures and a short growing season. In geology, it relates to a wide variety of rocks and soil below 0° C. containing ice, generally classified into short-term permafrost, seasonal permafrost, and perennial permafrost. Freeze heave refers to the seasonal permafrost or permafrost regions, where a cold-season soil freezes and expands, causing a transmission line tower support foundation fixed in the permafrost to lift due to tangential forces of freezing and expansion, resulting in a loss of fixation capability. During the warm-season thaw, the soil settles back down, making it difficult for the uplifted transmission line tower support foundation to return to its original position, resulting in the permafrost uplift.

Because of the foregoing, it is desired to provide a transmission line tower base with electrothermal air-blowing anti-frost heave functions for permafrost regions, capable of increasing the support and fixation of the base in the event of frost heave.

SUMMARY

One or more embodiments of the present disclosure provide a transmission line tower base with electrothermal air-blowing anti-frost heave functions for permafrost regions. The transmission line tower base may include a pile foundation cylinder, a cylinder top seat, a cylinder base, a transmission line tower connection frame, a support column inside the pile foundation cylinder, arcuate tubes, heating rods, and a top air-blowing device. The cylinder top seat may be fixedly provided at a top of the pile foundation cylinder, and the transmission line tower connection frame may be fixedly mounted on the cylinder top seat for connecting to a bottom foot of a transmission line tower body. The cylinder base may be provided at a bottom of the pile foundation cylinder and may include a plurality of threaded drill rod assemblies, and the cylinder base may be configured to anchor the cylinder base to a foundation. The pile foundation cylinder may include a hollow installation cavity, and the support column may be embedded in the installation cavity. Two vertical grooves may be symmetrically formed on a cavity wall of the installation cavity, two diameter-expanding wing plates may be symmetrically arranged on an outer wall of a lower portion of the pile foundation cylinder, and the two diameter-expanding wing plates are respectively positioned below the two vertical grooves. Each diameter-expanding wing plate may include an inclined channel, a top of the inclined channel may be communicated with a bottom of a corresponding vertical groove, and a plurality of installation through-holes may be symmetrically formed on front and rear surfaces of each diameter-expanding wing plate, the arcuate tubes may be provided at front and rear surfaces of the two diameter-expanding wing plates through the plurality of installation through-holes to connect the inclined channels of the two diameter-expanding wing plates with the arcuate tubes. A top portion of the support column includes an equipment installation chamber, and two passageways may be symmetrically formed on a wall of the equipment installation chamber, and the two passageways may be in one-to-one correspondence with and communicate with the two vertical grooves. Two heating rods may be symmetrically connected to an outer wall of the support column through hinge connectors, the two heating rods may be respectively inserted into two inclined channels of the pile foundation cylinder, and a cross-section of each heating rod may be smaller than a cross-section of each inclined channel and a cross-section of each vertical groove. The top air-blowing device may be arranged at the top of the pile foundation cylinder and includes an outer casing, a fan, and a fan drive motor. The outer casing may be fixedly provided at the top of the pile foundation cylinder, the fan and the fan drive motor are located in the outer casing, the fan may be connected to the fan drive motor through a connecting shaft, a top cover may be provided at a top of the outer casing, a side vent pipe may be provided on a side wall of the outer casing, and a filter may be mounted at a port of the side vent pipe. The cylinder top seat and the transmission line tower connection frame may be mounted on a wall of the pile foundation cylinder below the equipment installation chamber.

In some embodiments, the pile foundation cylinder may be provided into the foundation, and during installation, a foundation hole may be excavated in the foundation, the pile foundation cylinder may be provided into the hole, and backfilled.

In some embodiments, the cylinder base may have an inverted conical shape.

In some embodiments, each threaded drill rod assembly among the plurality of threaded drill rod assemblies may include a threaded sleeve and a threaded drill rod, the threaded sleeve may be fixedly provided at the cylinder base, the threaded drill rod may be screwed through and provided in the threaded sleeve, and the threaded drill rod may be configured to penetrate into the foundation to maintain stability of the pile foundation cylinder.

In some embodiments, a reduced-diameter step may be formed at a bottom of the installation cavity to limit a lower installation position of the support column.

In some embodiments, a first cable passage with vertical penetration may be formed through the bottom of the pile foundation cylinder. A second cable passage may be axially formed through the support column, with a lower end communicating with the first cable passage. A third cable passage may be axially formed through the cylinder base, with a top communicating with a bottom of the first cable passage. A temperature sensor may be embedded at a bottom of the cylinder base, and a cable of the temperature sensor may extend through the third cable passage, the first cable passage, and the second cable passage into the equipment installation chamber.

In some embodiments, a fourth horizontal cable passage may be formed in the support column at a position corresponding to a top end of each heating rod, communicating with the second cable passage, cables of the two heating rods extend through the fourth cable passage and the second cable passage into the equipment installation chamber.

In some embodiments, a controller may be provided in the equipment installation chamber, electrically connected to the temperature sensor, the two heating rods, and the fan drive motor, and configured to automatically activate the two heating rods and the fan based on temperature data from the temperature sensor.

In some embodiments, the fan may direct airflow downward into the two inclined channels through the passageways and the vertical grooves, forcing heat from the two heating rods in the two inclined channels to transfer into the arcuate tubes with the airflow, thereby dispersing the heat into surrounding soil to raise temperature of the surrounding soil.

BRIEF DESCRIPTION OF THE DRAWINGS

The present disclosure is further illustrated in terms of exemplary embodiments. These exemplary embodiments are described in detail with reference to the drawings. These embodiments are non-limiting exemplary embodiments, in which like reference numerals represent similar structures, and wherein.

DETAILED DESCRIPTION

Figure 1:
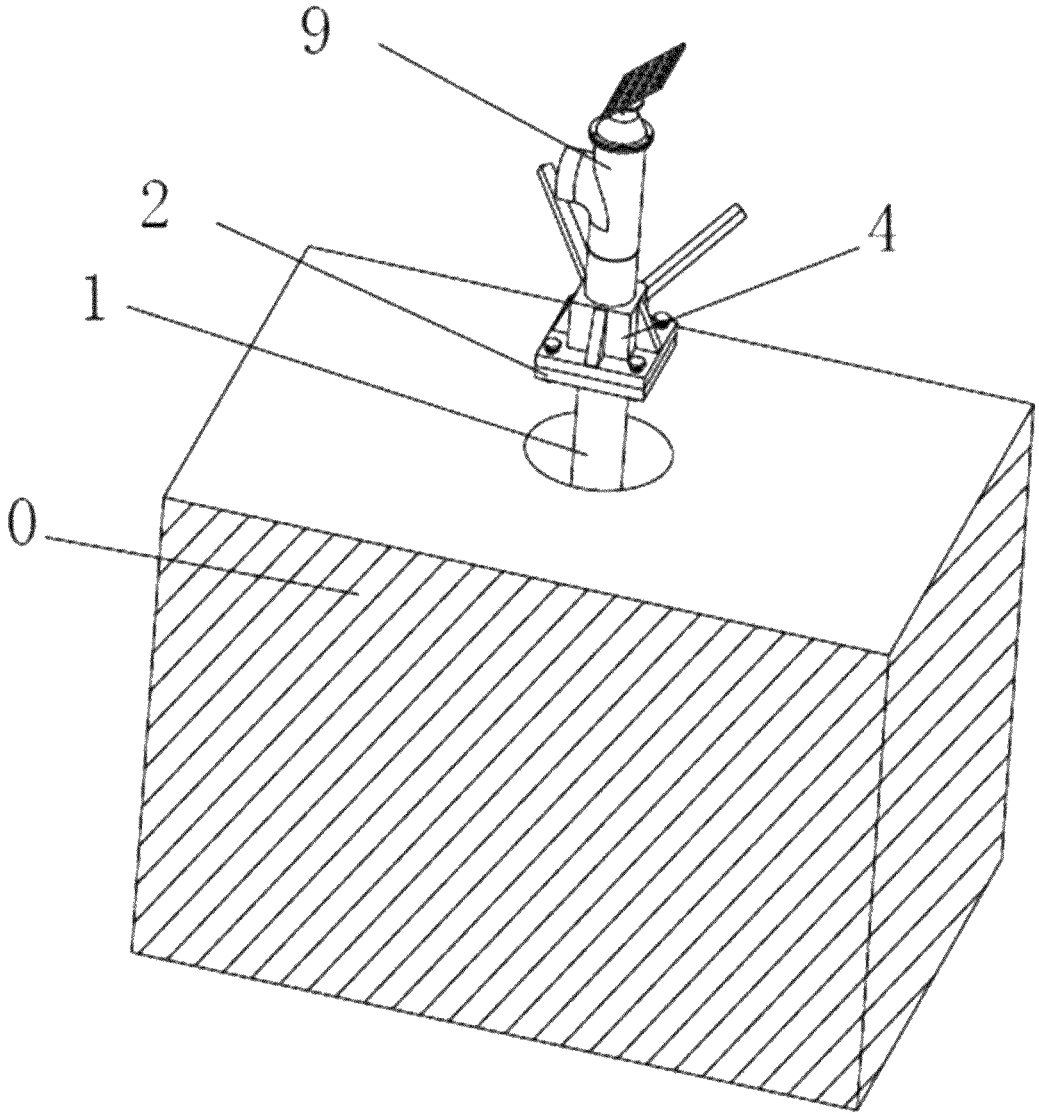
FIG. 1 is a schematic diagram illustrating an installation of a transmission line tower base according to some embodiments of the present disclosure.

To more clearly illustrate the technical solutions related to the embodiments of the present disclosure, a brief introduction of the drawings referred to the description of the embodiments is provided below. Obviously, the drawings described below are only some examples or embodiments of the present disclosure. Those having ordinary skills in the art, without further creative efforts, may apply the present disclosure to other similar scenarios according to these drawings. Unless obviously obtained from the context or the context illustrates otherwise, the same numeral in the drawings refers to the same structure or operation.

It should be understood that "system", "device", "unit" and/or "module" as used herein is a manner used to distinguish different components, elements, parts, sections, or assemblies at different levels. However, if other words serve the same purpose, the words may be replaced by other expressions.

As shown in the present disclosure and claims, the words "one", "a", "a kind" and/or "the" are not especially singular but may include the plural unless the context expressly suggests otherwise. In general, the terms "comprise", "comprises", "comprising", "include", "includes", and/or "including", merely prompt to include operations and elements that have been clearly identified, and these operations and elements do not constitute an exclusive listing. The methods or devices may also include other operations or elements.

Embodiments of the present disclosure provide a transmission line tower base with electrothermal air-blowing anti-frost heave functions for permafrost regions (hereinafter referred to as the "transmission line tower base" or "base"). The transmission line tower base utilizes arcuate tubes to form an airflow channel between a support column inside a pile foundation cylinder and the pile foundation cylinder, where heating rods and a top air-blowing device are installed. The blowing airflow of the top air-blowing device blows into the airflow channel, prompting the heat of the heating rods in the airflow channel to be fully emitted to the surrounding soil, effectively raising the temperature of the surrounding soil, and avoiding excessive freezing and pulling effect of the soil when the temperature of the soil is too low.

Figure 2:
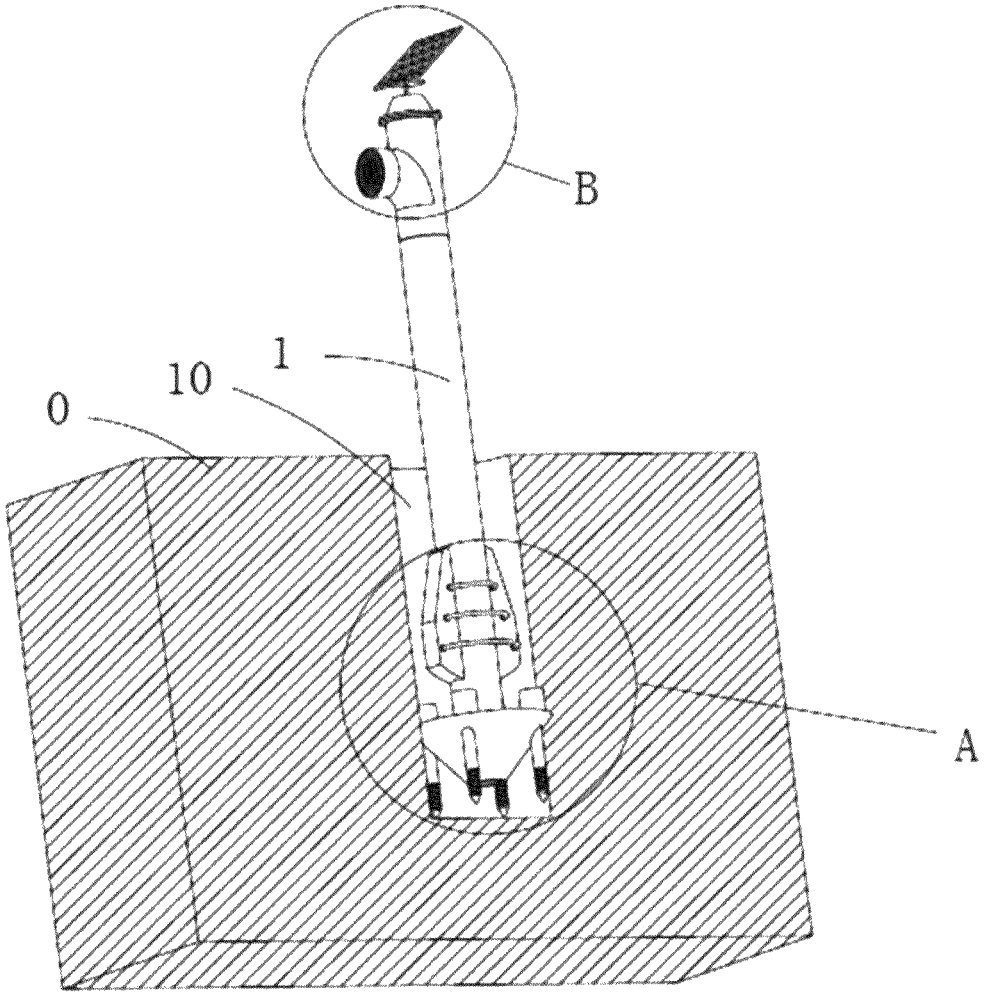
FIG. 2 is a schematic diagram illustrating a cross-sectional installation of a transmission line tower base according to some embodiments of the present disclosure.
Figure 3:
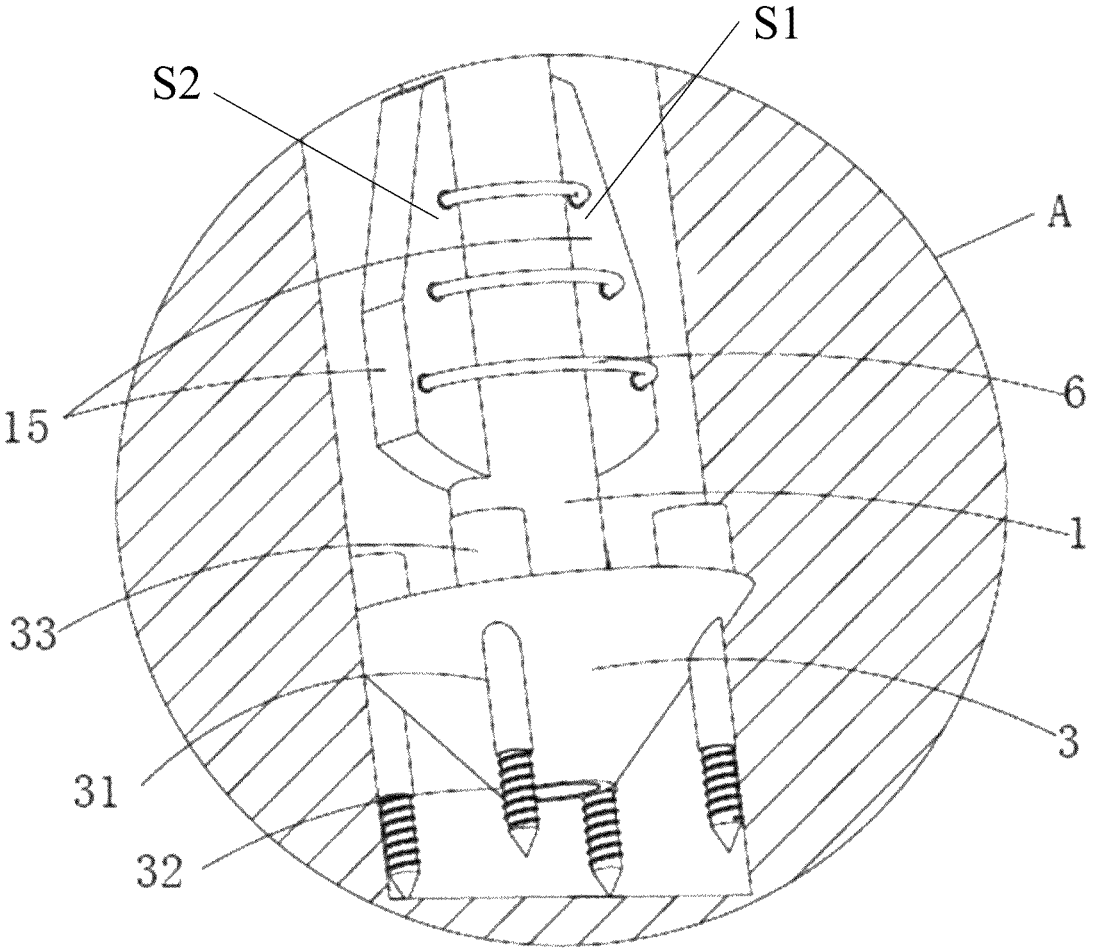
FIG. 3 is an enlarged schematic at position A of FIG. 2.

FIG. 1 is a schematic diagram illustrating an installation of a transmission line tower base according to some embodiments of the present disclosure. FIG. 2 is a schematic diagram illustrating a cross-sectional installation of a transmission line tower base according to some embodiments of the present disclosure. FIG. 3 is an enlarged schematic at position A of FIG. 2.

Figure 6:
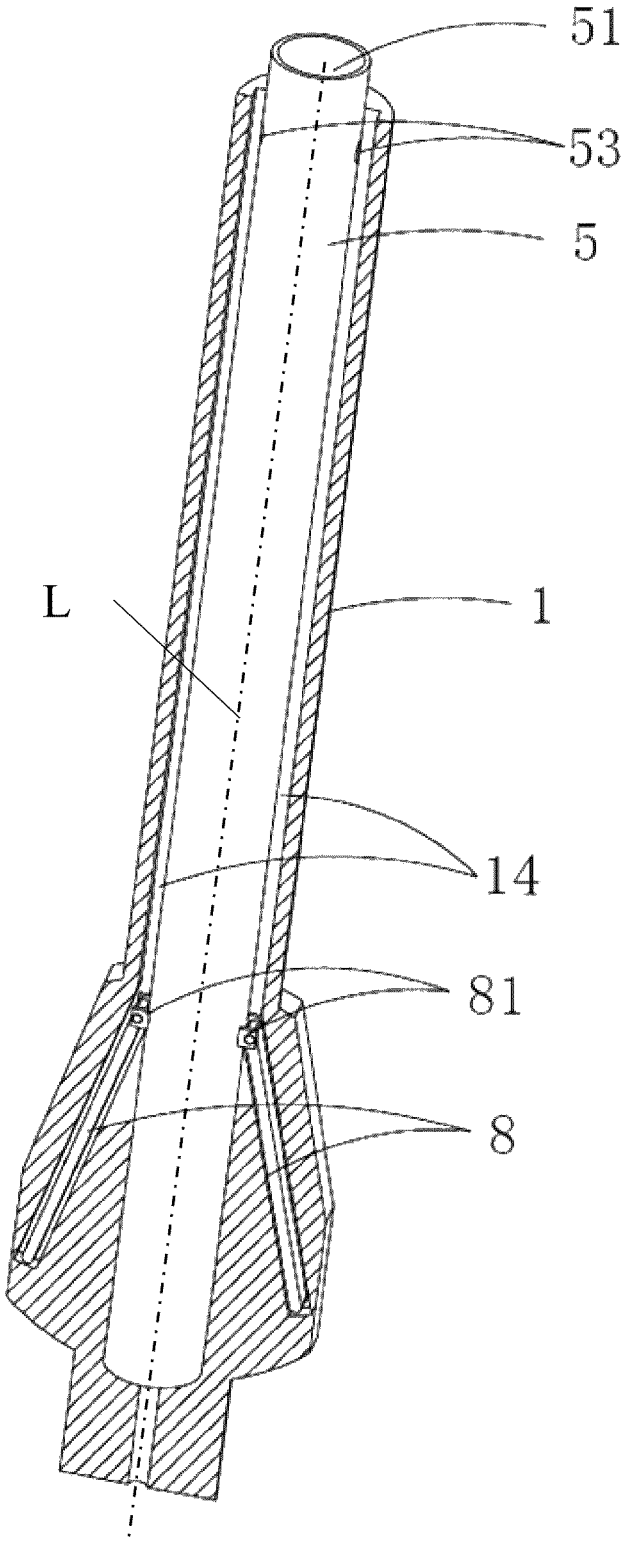
FIG. 6 is a schematic diagram illustrating a structure of a combined state of a pile foundation cylinder, a support column, and heating rods according to some embodiments of the present disclosure.

In some embodiments, as shown in FIGS. 1-3, the base includes a pile foundation cylinder 1, a cylinder top seat 2, a cylinder base 3, a transmission line tower connection frame 4, a support column 5 inside the pile foundation cylinder 1 (as shown in FIG. 6), arcuate tubes 6, a temperature sensor 7, heating rods 8, and a top air-blowing device 9.

The pile foundation cylinder 1 refers to a cylinder structure in the base that is pre-buried into the foundation. In some embodiments, the pile foundation cylinder 1 may be set in a variety of forms based on practical requirements, for example, a circular barrel, a square barrel, or the like. The cylinder top seat 2 refers to a structure located on top of the pile foundation cylinder 1. In some embodiments, the cylinder top seat 2 is connected to the pile foundation cylinder 1 by bolting, welding, or the like.

In some embodiments, the pile foundation cylinder 1 is installed in the foundation 0. During construction, crews or construction equipment may excavate a foundation hole 10 in the foundation 0, and then install the pile foundation cylinder 1 into the foundation hole 10 and backfill.

The transmission line tower connection frame 4 refers to a connection frame that is fixed to the cylinder top seat 2.

In some embodiments, the pile foundation cylinder 1 is fixedly mounted with the cylinder top seat 2 at the top of the pile foundation cylinder 1, and the transmission line tower connection frame 4 may be fixedly mounted on the cylinder top seat 2 by bolting, welding, or the like. The transmission line tower connection frame 4 is fixedly mounted on the cylinder top seat for connecting to a bottom foot of a transmission line tower body. That is, each of the bottom feet of the transmission line pole tower body is separately connected to the transmission line tower base having a threaded drill rod assembly according to some embodiments of the present disclosure.

Figure 4:
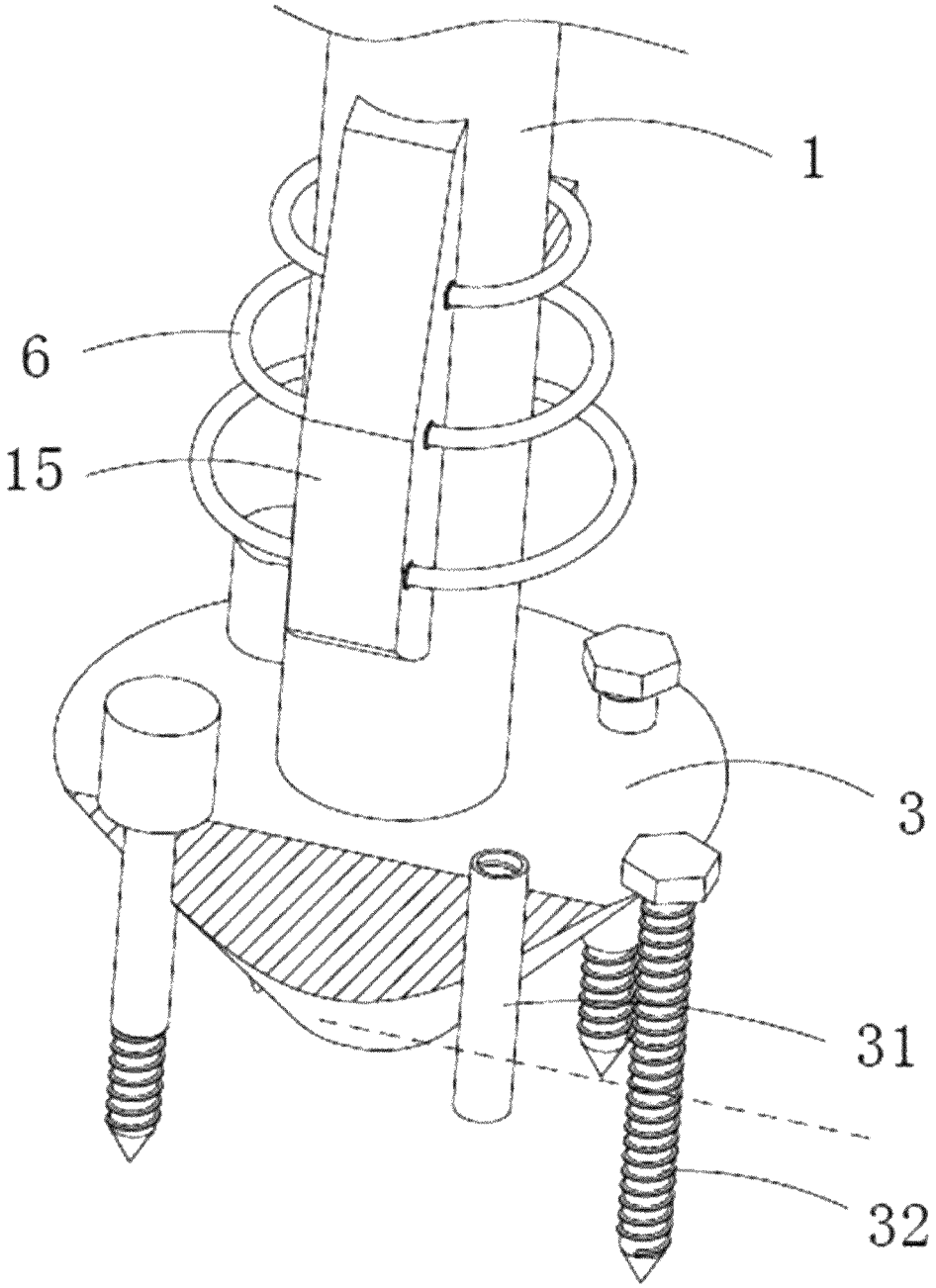
FIG. 4 is a schematic diagram illustrating a bottom structure of a transmission line tower base according to some embodiments of the present disclosure.

FIG. 4 is a schematic diagram illustrating a bottom structure of a transmission line tower base according to some embodiments of the present disclosure.

In some embodiments, as shown in FIG. 3 and FIG. 4, the cylinder base 3 is provided at a bottom of the pile foundation cylinder 1 and includes a plurality of threaded drill rod assemblies, and the cylinder base is configured to anchor the cylinder base to the foundation.

The cylinder base 3 refers to the component at the bottom of the pile foundation cylinder 1. The cylinder base 3 has an inverted conical shape, and the inverted conical shape of the cylinder base 3 enables a downward compression effect of the subsoil inside a foundation hole.

In some embodiments, each threaded drill rod assembly among the plurality of threaded drill rod assemblies includes a threaded sleeve 31 and a threaded drill rod 32, the threaded sleeve 31 being fixedly disposed on the cylinder base 3, the threaded drill rod 32 being screwed through and provided in the threaded sleeve 31, and the threaded drill rod 32 being configured to penetrate into the foundation to maintain the stability of the pile foundation cylinder 1. In some embodiments, the threaded drill rod assembly further includes a protective cap 33, which is mounted on top of the threaded drill rod 32.

In some embodiments, the threaded sleeve 31 is internally threaded for screwing and unscrewing the threaded drill rod 32. The threaded drill rod 32 may be rotated through the threaded sleeve 31 and drilled into the foundation 0 to provide resistance to pullout and lateral movement, preventing the pile foundation cylinder from settling or tilting. The length of the threaded drill rod 32 is compatible with the threaded sleeve 31, and the length may be set according to actual needs. The protective cap 33 protects the engagement region between the threaded drill rod 32 and the threaded sleeve 31 from rusting or clogging, and ensures that it can be removed or adjusted subsequently.

In some embodiments of the present disclosure, when the base is constructed, a construction crew or construction equipment does not need to excavate and pour concrete on a large area of the original foundation (the concrete causes alkalization of construction area, affecting the growth of the surrounding vegetation), but only needs to excavate the foundation hole, install the threaded drill rod, and backfill the base soil, which is suitable for the natural reserve of the permafrost and avoids ecological damage.

Figure 5:
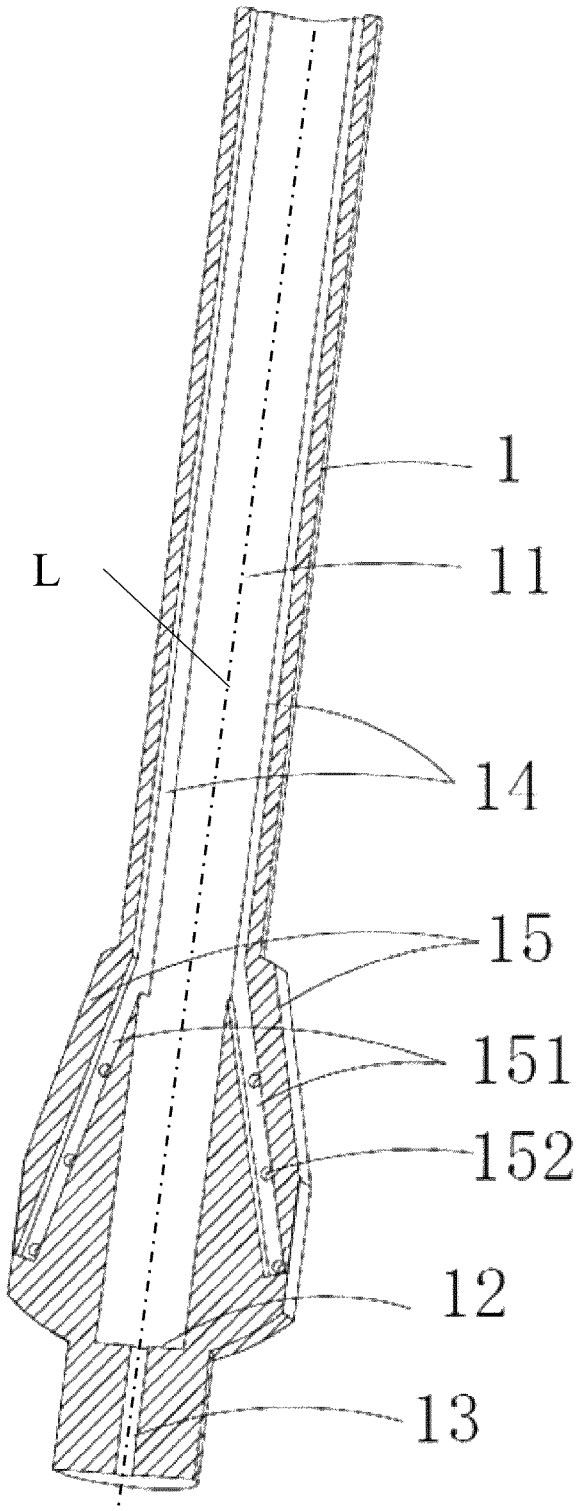
FIG. 5 is a schematic diagram illustrating a structure of a pile foundation cylinder according to some embodiments of the present disclosure.
Figure 7:
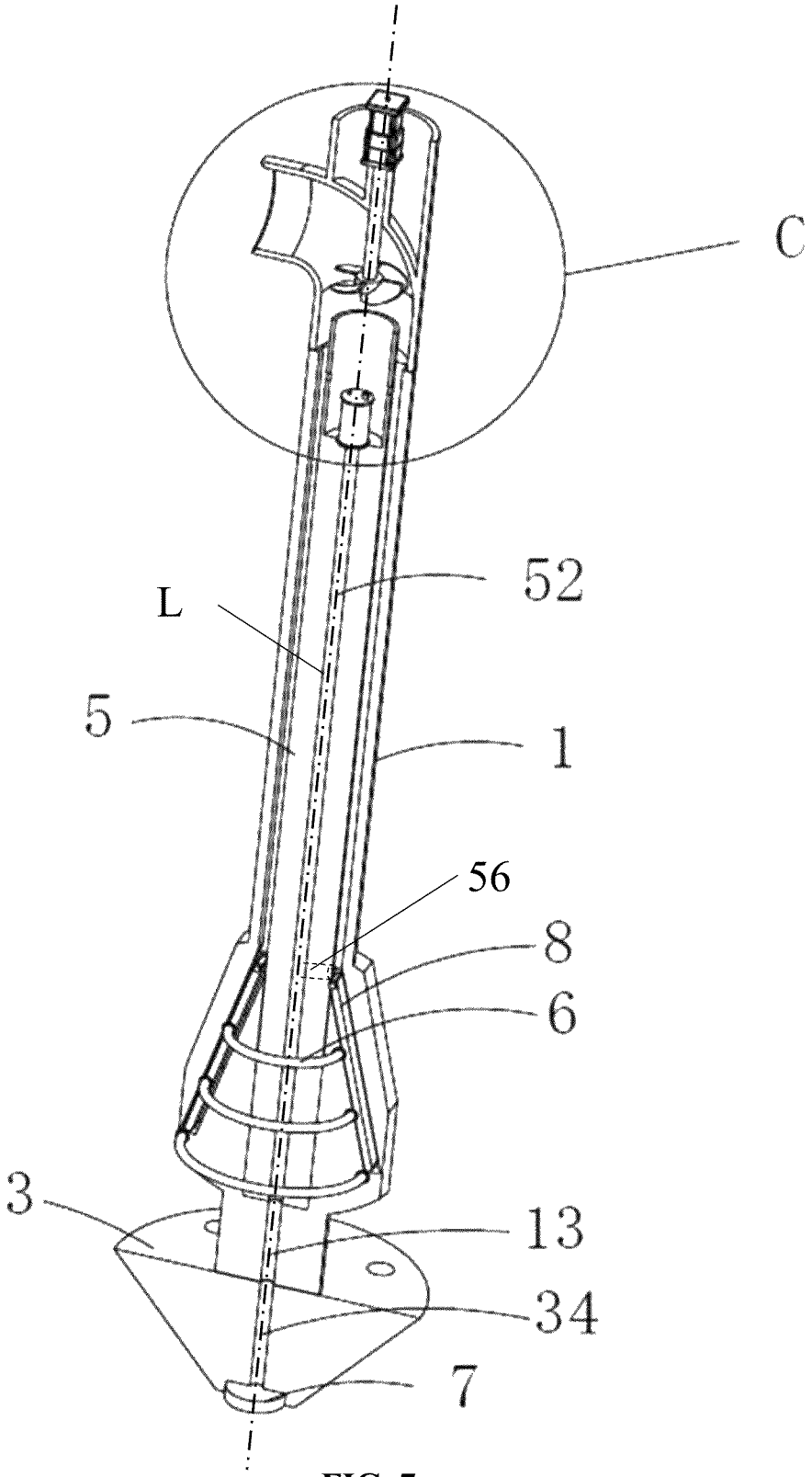
FIG. 7 is a schematic diagram illustrating an internal structure of a transmission line tower base according to some embodiments of the present disclosure.
Figure 8:
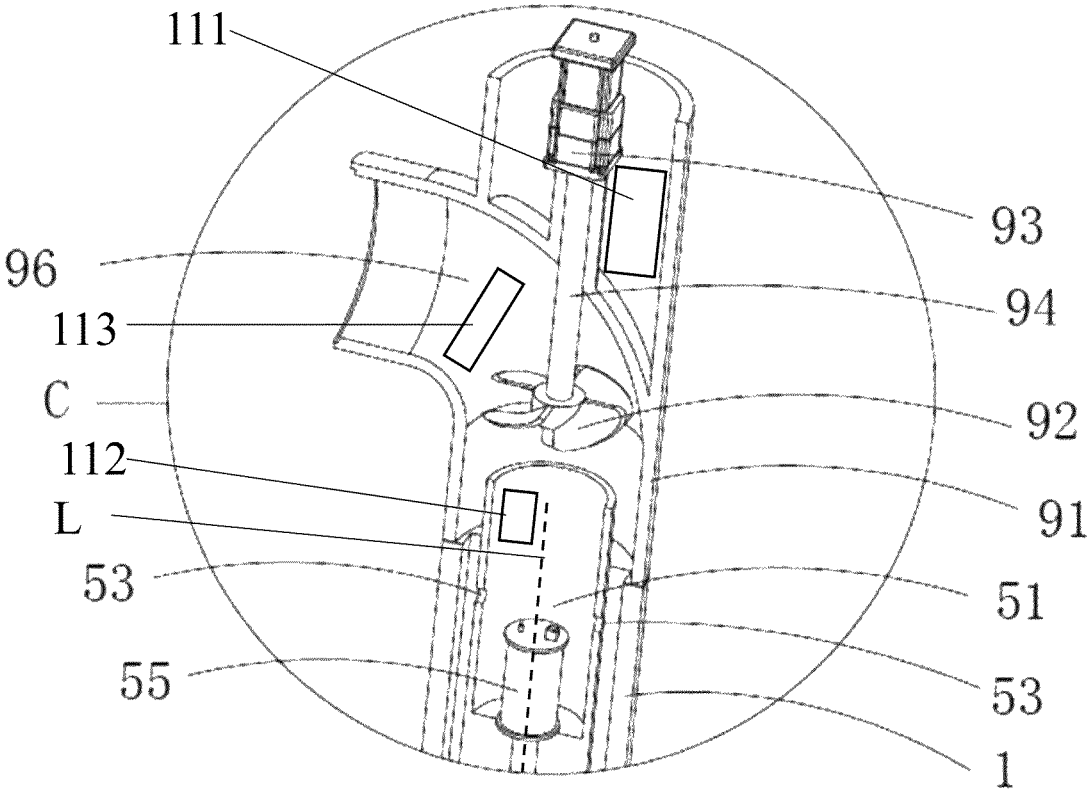
FIG. 8 is an enlarged schematic of position C of FIG. 7.
Figure 9:
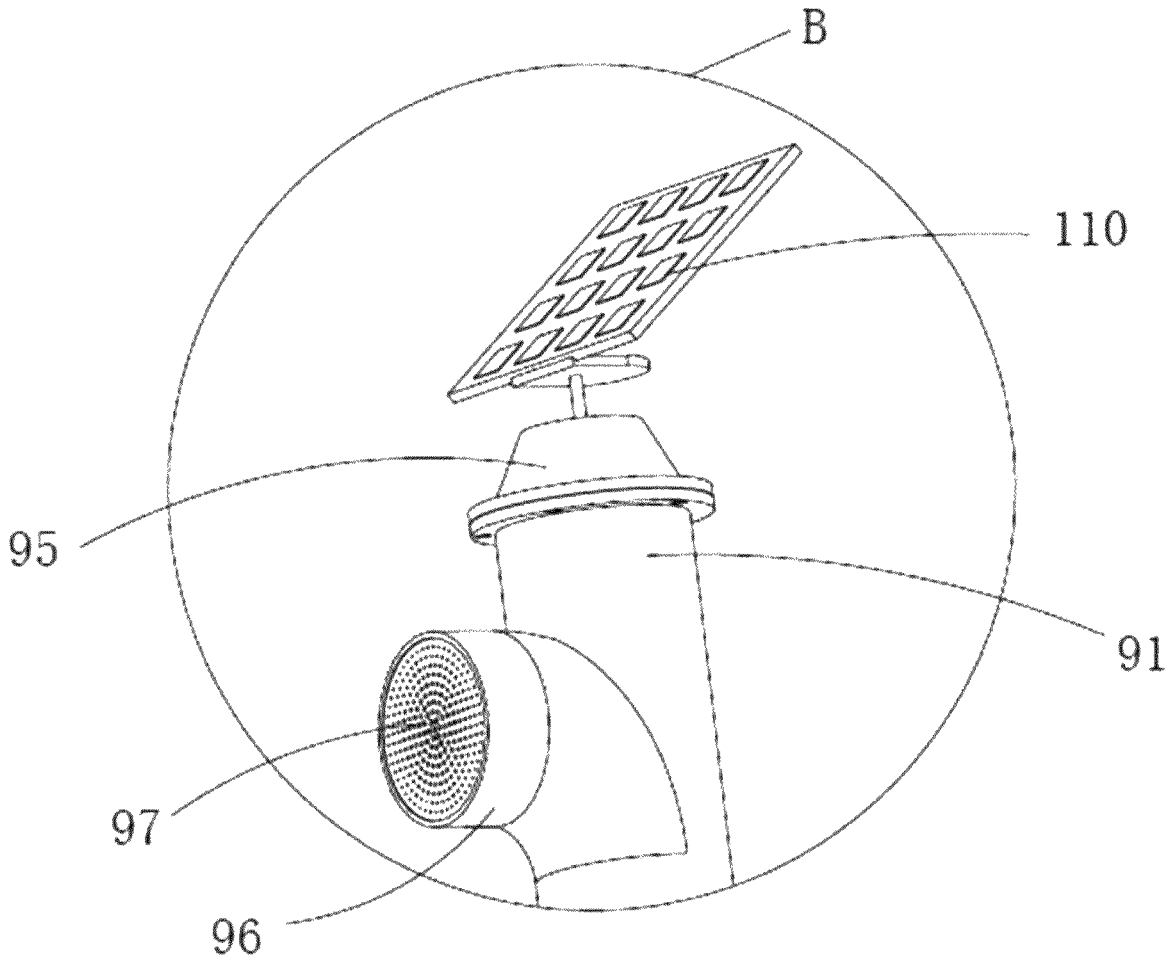
FIG. 9 is an enlarged schematic of position B of FIG. 2.

FIG. 5 is a schematic diagram illustrating a structure of a pile foundation cylinder according to some embodiments of the present disclosure. FIG. 6 is a schematic structural diagram illustrating a structure of a combined state of a pile foundation cylinder, a support column, and heating rods according to some embodiments of the present disclosure. FIG. 7 is a schematic diagram illustrating an internal structure of a transmission line tower base according to some embodiments of the present disclosure. FIG. 8 is an enlarged schematic of position C of FIG. 7. FIG. 9 is an enlarged schematic of position B of FIG. 2.

In some embodiments, as shown in FIG. 5 to FIG. 9, the pile foundation cylinder 1 has an installation cavity 11 inside the pile foundation cylinder 1, and the support column 5 is nested in the installation cavity 11 of the pile foundation cylinder 1. The support column 5 refers to a reinforcing member provided in the interior of the pile foundation cylinder 1. In some embodiments, the support column 5 may be made of high-strength steel or thicker steel to ensure the support strength of the pile foundation cylinder 1. The installation cavity 11 refers to a cavity inside the pile foundation cylinder 1 for installing the support column 5.

In some embodiments, two vertical grooves 14 are symmetrically formed on a cavity wall of the installation cavity 11 of the pile foundation cylinder 1 (as shown in FIG. 5, the two vertical grooves 14 are arranged symmetrically along the axis L of the pile foundation cylinder 1). In addition, two diameter-expanding wing plates 15 are symmetrically arranged on an outer wall of a lower portion of the pile foundation cylinder 1 (as shown in FIG. 5, the two diameter-expanding wing plates 15 are symmetrically located along the axis L of the pile foundation cylinder 1) and are respectively positioned below the two vertical grooves 14. Each diameter-expanding wing plate 15 includes an inclined channel 151, and the top of which communicates with the bottom of a corresponding vertical groove 14. A plurality of installation through-holes 152 are symmetrically formed on its front and rear surfaces (as shown in FIG. 3, with one wing plate observed at S1 on its front side and the other at S2 on its rear side). The arcuate tubes 6 are provided on the front and rear surfaces of the two diameter-expanding wing plates 15 through the installation through-holes 152 to connect the inclined channels 151 of the diameter-expanding wing plates with the arcuate tubes 6 (refer to FIG. 4).

The arcuate tubes 6 refer to conduits for ventilation or heat dissipation. In some embodiments, the plurality of arcuate tubes 6 is provided radially parallel to the outer side of the pile foundation cylinder 1, and the curvature of the plurality of arcuate tubes 6 matches the shape of the pile foundation cylinder. For example, when the pile foundation cylinder is a circular barrel and there are three arcuate tubes 6 provided, the curvature of the three arcuate tubes 6 matches the curvature of the pile foundation cylinder. This reduces airflow resistance and enhances ventilation or heat dissipation.

The vertical groove 14 refers to a recess parallel to the axial direction of the pile foundation cylinder 1. The diameter-expanding wing plates 15 refer to wings that extend toward the exterior of the pile foundation cylinder 1. The inclined channel 151 refers to a channel within the diameter-expanding wing plates 15 for installing the heating rods. The installation through-holes 152 refer to apertures for mounting the arcuate tubes 6.

In some embodiments, a reduced-diameter step 12 is formed at a bottom of the installation cavity 11 to limit a lower installation position of the support column 5.

The temperature sensor 7 refers to a sensor for monitoring temperature. In some embodiments, the temperature sensor 7 may detect a temperature of the base in real time or at regular intervals, thus monitoring the temperature of the soil.

In some embodiments, as shown in FIG. 6-FIG. 8, the support column 5 is embedded securely in the installation cavity 11 inside the pile foundation cylinder 1 in contact with the installation cavity 11, and the support column 5 provides stabilizing support for the entire pile foundation.

In some embodiments, the top of the support column 5 has a section of the equipment installation chamber 51. The equipment installation chamber 51 is configured to mount equipment such as a controller 55.

The equipment installation chamber 51 refers to a chamber in which equipment is mounted in an upper portion of the pile foundation cylinder 1. A second cable passage 52 refers to an aperture opened at the axis of the support column 5. A third cable passage 34 refers to an aperture opened at the center of the axis of the cylinder base 3.

In some embodiments, as shown in FIG. 1, the cylinder top seat 2 and the transmission line tower connection frame 4 are mounted on a wall of the pile foundation cylinder 1 below the equipment installation chamber 51. Because the equipment installation chamber 51 is a cavity structure, the strength of the material at the location where the equipment installation chamber 51 is located may be weaker. Based on the above structure, the support column 5 of the pile foundation cylinder can ensure the strength for supporting the pile foundation cylinder 1.

In some embodiments, a first cable passage 13 vertically penetrating the interior of the reduced-diameter step 12 of the pile foundation cylinder 1, which is provided for wiring of the temperature sensor 7.

In some embodiments, an axis of the support column 5 (as shown in FIG. 7, the axis may refer to the axis L) is further provided with a second cable passage 52, the bottom end of the second cable passage 52 being in communication with the first cable passage 13 at the bottom of the pile foundation cylinder 1.

In some embodiments, a third cable passage 34 is also provided in the axis (as shown in FIG. 7, the axis may refer to the axis L) of the cylinder base 3, the top of the third cable passage 34 being in communication with the bottom of the first cable passage 13. The temperature sensor 7 is embedded at the bottom of the cylinder base 3, and a cable of the temperature sensor 7 may pass sequentially through the third cable passage 34, the first cable passage 13, and the second cable passage 52, and then be routed to the equipment installation chamber 51 at a top of the support column 5, so that the cable may be connected to the controller 55.

In some embodiments, two passageways 53 are symmetrically disposed on the wall of the equipment installation chamber 51 of the support column 5 (e.g., the two passageways 53 are symmetrically disposed along the axis L of the support column 5) corresponding to the vertical groove 14. When the support column 5 is embedded into the pile foundation cylinder 1, the two vertical grooves 14 form two channels, and the two passageways 53 are in one-to-one correspondence with and communicate with the two vertical grooves 14 (i.e., the formed two channels).

In some embodiments, two heating rods 8 are symmetrically connected to an outer wall of the support column 5 through hinge connectors 81 (the two heating rods 8 are arranged symmetrically along the axis L as shown in FIG. 6). The two heating rods 8 are inserted into two inclined channels 151 of the pile foundation cylinder 1, and a cross-section of each heating rod 8 is smaller than a cross-section of the corresponding inclined channel 151 as well as a cross-section of the corresponding vertical groove 14.

The heating rods 8 refer to heating elements that convert other energy sources into heat, such as an electric heating rod, an electric heating wire, or the like. In some embodiments, the heating rods 8 may create heat by heating to prevent freezing of the soil based on the temperature of the soil monitored by the temperature sensor.

Because the top of the heating rods 8 is hingedly connected to the support column 5, the technician may easily pull out or insert the heating rods 8 into the inclined channel 151 (i.e., during pulling out or inserting of the heating rods 8, the heating rods 8 may slide along the vertical groove 14 of the pile foundation cylinder 1 with movement of the support column 5).

In some embodiments, a horizontal fourth cable passage 56 (as shown in FIG. 7) is formed in the support column 5 at a position corresponding to a top end of each heating rod 8, communicating with the second cable passage 52, cables of the two heating rods 8 may sequentially extend through the fourth cable passage 56 and the second cable passage 52 into the equipment installation chamber 51.

The passageways 53 refer to channels in the side wall of the equipment installation chamber 51. The fourth cable passage refers to a channel for leading the cable of the heating rods 8. The hinge connector 81 refers to a connector for articulating the heating rods 8 to the support column 5.

The top air-blowing device 9 refers to a device for performing ventilation or heat dissipation. For example, the top air-blowing device 9 includes a fan, a blower, or the like. In some embodiments, the top air-blowing device 9 may blow an air stream with heat to prevent freezing of the soil when the heating rods 8 create heat.

In some embodiments, the top air-blowing device 9 is provided at the top of the pile foundation cylinder 1 (as shown in FIG. 1). As shown in FIG. 8-FIG. 9, the top air-blowing device 9 includes an outer casing 91, a fan 92, and a fan drive motor 93. The outer casing 91 is fixedly mounted on the top of the pile foundation cylinder 1, the fan 92 and the fan drive motor 93 are located inside the outer casing 91, and the fan 92 is connected to the fan drive motor 93 via a connecting shaft 94. The top of the outer casing 91 is provided with a top cover 95, a side vent pipe 96 is also provided on the side wall of the outer casing 91, and a filter 97 is mounted at a port of the side vent pipe 96 to prevent external impurities from entering.

In some embodiments, an airflow channel is formed between a support column and the pile foundation cylinder by using arcuate tubes, and the heating rods and the top air-blowing device are provided inside the airflow channel. The blowing airflow from the top air-blowing device is blown into the airflow channel, which induces the heat of the heating rods in the airflow channel to be fully distributed to the surrounding soil, effectively raising the temperature of the surrounding soil and avoiding the freezing and pulling effect when the temperature of the soil is too low.

In some embodiments, the fan 92 directs airflow downward (i.e., toward the foundation 0). When the fan drive motor 93 drives the fan 92 to rotate, the fan 92 blows air to the lower part thereof, and the airflow enters into the inclined channel 151 through the passageways 53 and the vertical groove 14, thereby inducing the heat of the heating rods 8 in the inclined channel 151 to better diffuse through the arcuate tubes 6 along with the airflow, more fully emitting the heat into the surrounding soil, and raising the temperature of the surrounding soil.

In some embodiments, the outer casing 91, the top cover 95, the side vent pipe 96, and the filter 97 may be integrally molded or removably connected. The side vent pipe 96 and the filter 97 are removably connected to allow for easy replacement and cleaning of the filter 97. The outer casing 91, the top cover 95, the side vent pipe 96, and the filter 97 may be made of a material (e.g., PC) having fire, water, and mold-resistant properties.

In some embodiments, the top cover 95 of the top air-blowing device 9 is also provided with a solar panel 110 for powering the internal power-consuming devices of the embodiments of the present disclosure (e.g., the temperature sensor 7, the heating rods 8, and the top air-blowing device 9, the controller 55, etc.). In addition, external cables may be configured to power internal power-consuming devices.

In some embodiments, the solar panel 110 is connected with a battery 111 (shown in FIG. 8), and the battery 111 is capable of storing electrical energy from the solar panel 110.

Figure 10:
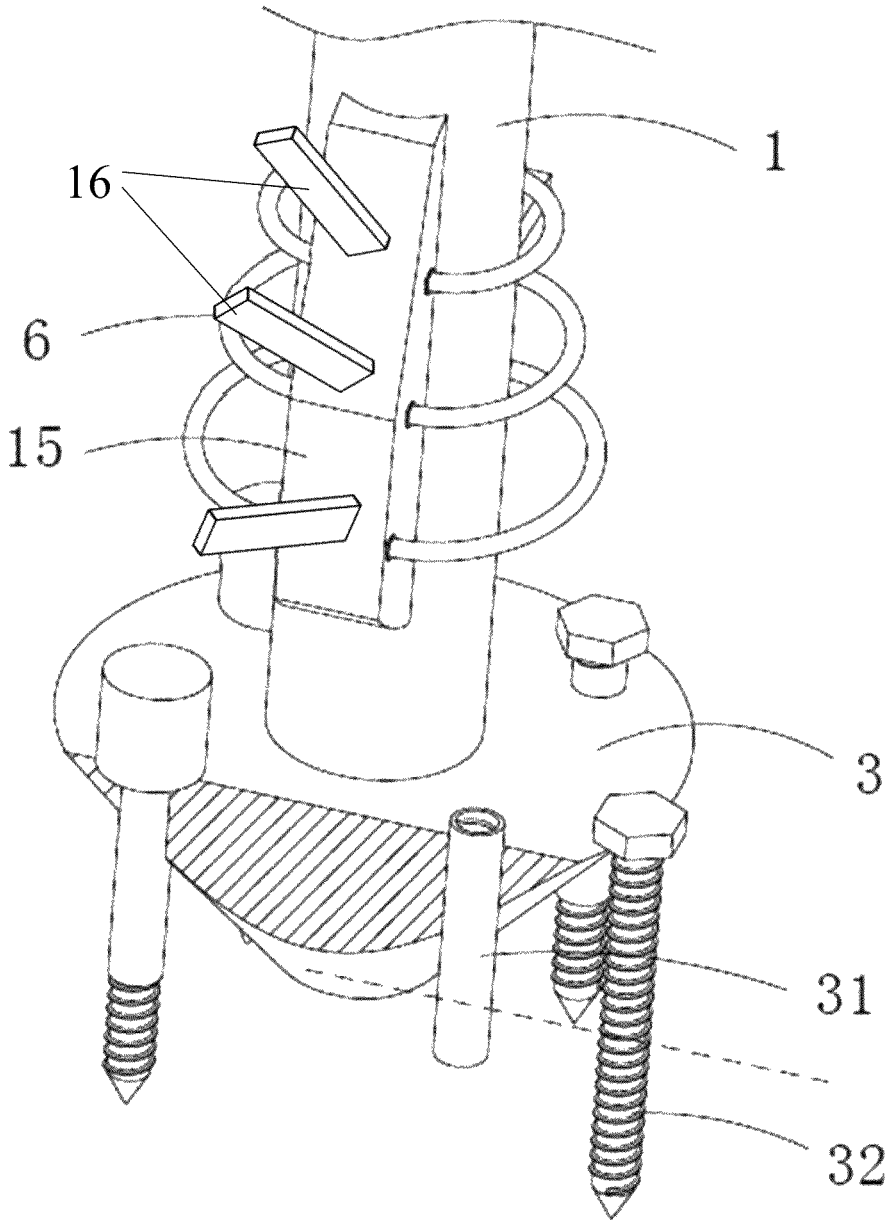
FIG. 10 is a schematic diagram illustrating a branching structure according to some embodiments of the present disclosure.

FIG. 10 is a schematic diagram illustrating a branching structure according to some embodiments of the present disclosure.

In some embodiments, at least one of the diameter-expanding wing plate 15 and the arcuate tubes 6 is provided with an outwardly extending branching structure 16 on the outer surface.

The branching structure 16 refers to a structure that extends outward. For example, the branching structure 16 may include a tree root-like branching structure, a fin branching structure, or the like. When the branching structure 16 is provided on the diameter-expanding wing plate 15, and the branching structure 16 may be in the form of a rectangular shape. When the branching structure 16 is provided at the arcuate tubes 6, the branching structure 16 may be a hollow tube similar to the arcuate tubes 6, with the interior of the branching structure 16 being internally in communication with the interior of the arcuate tubes 6. In some embodiments, as shown in FIG. 10, the outer surface of the diameter-expanding wing plate 15 is provided with the branching structure 16 extending outwardly. The branching structure 16 is fixed to the diameter-expanding wing plate 15 by welding, or the like. The branching structure 16 may increase the contact area of the expanding wing plate 15 and the arcuate tubes 6 with the frozen soil.

According to some embodiments of the present disclosure, the branching structure may increase the contact area of the diameter-expanding wing plates and the arcuate tubes with the permafrost as compared to the diameter-expanding wing plates and the arcuate tubes with smooth surfaces, improving the heat dissipation efficiency and further decreasing the likelihood of the occurrence of the frost heave effect.

In some embodiments, a controller 55 is provided in the equipment installation chamber 51, and the temperature sensor 7, the heating rods 8, and the fan drive motor 93 are electrically connected to the controller 55. The controller automatically controls the heating rods 8 and the fan drive motor 93 to operate based on the data condition detected by the temperature sensor 7.

The controller 55 refers to a component that controls a device in the base to perform a related task. In some embodiments, the controller 55 may include a processing unit, a storage unit, and a communication unit. The processing unit and the storage unit are configured to process and store data, respectively, as the device in the base performs the related task. The processing unit may include one of a central processing unit (CPU), a microprocessor, or the like, and the storage unit may include one of random access memory (RAM), read-only memory (ROM), or the like. The communication unit is configured to receive and send data when the device in the base performs the related task.

In some embodiments, the controller is further configured to, in response to determining that a current moment is a detection moment, determine heating parameters and fan parameters based on temperature data and an energy amount of the solar panel at the current moment. The heating parameters include an operating power of the heating rods and an operating time period of the heating rods within a preset future period, and the fan parameters include an operating power of the fan drive motor and an operating time period of the fan drive motor within the preset future period. The controller is further configured to control, based on the operating power of the heating rods, the heating rods to heat during the operating time period of the heating rods, and control, based on the operating power of the fan drive motor, the fan drive motor to drive the fan to blow air during the operating time period of the fan drive motor.

The detection moment refers to a preset detection time point, for example, 10:00, 12:00, 14:00, etc., every day. The temperature data at the current moment refers to the data transmitted from the temperature sensor 7 to the controller at the current moment.

The energy amount of the solar panel (hereinafter referred to as the energy amount) refers to the amount of electricity generated by the solar panel 110. For example, the energy amount of the solar panel includes the amount of electricity generated over a period of time, calculated based on an amount of radiant energy received per unit of area over a current period of time. Merely by way of example, the energy amount of the solar panel may be determined by the following formula:

$$Ep = HA \times PAZ / Es \times K.$$

Ep denotes the amount of electricity generated by the solar panel, HA denotes the total solar irradiance in the horizontal plane, PAZ denotes the installed capacity, Es denotes the irradiance (constant) under standard conditions, and K denotes the power generation efficiency of the solar panel. PAZ, Es, and K may be determined by a technician based on the performance of the solar panel or a priori experience. HA may be obtained by a light sensor provided on the solar panel or on the surrounding ground surface.

The heating parameters refer to operating parameters related to heating. The heating parameters include the operating power of the heating rods and the operating time period of the heating rods during the preset future period.

The fan parameters refer to parameters related to the operation of the fan. The fan parameters include the power of operation of the fan drive motor during the preset future period and the operating time period of the fan drive motor. The operating time period of the heating rods and the operating time period of the fan drive motor may be the same as the preset future period, or may be less than the preset future period.

The preset future period refers to a period of time that extends forward from the current moment. The duration of the preset future period may be set empirically, e.g., 10 min, 1 h, or the like.

In some embodiments, the controller may determine the heating parameters and the fan parameters in a plurality of ways. For example, the controller may construct feature vectors based on temperature data and the energy amount of the solar panel at the current moment, and determine the heating parameters and the fan parameters by searching the feature vectors in a first vector database. The first vector database includes a plurality of reference vectors and a label corresponding to each reference vector. The label includes the heating parameters and the fan parameters. The reference vectors are constructed from temperature data and corresponding energy amount of the solar panel at the historical moment. The label corresponding to each reference vector is obtained by selecting, from a plurality of historical adjustments corresponding to the temperature data and the energy amount of the solar panel at the historical moment, historical heating parameters and historical fan parameters that exhibit the smallest deviation (i.e., the smallest tower offset value) for that moment, as the label corresponding to each reference vector.

In some embodiments, a displacement sensor 112 (as shown in FIG. 8) is also provided in the equipment installation chamber, the displacement sensor 112 being configured to obtain a tower offset value. The tower offset value refers to an offset value of the tower.

The controller may select the label corresponding to the reference vector with the smallest vector distance as the heating parameters and the fan parameters by calculating the vector distances between the feature vectors and the reference vectors.

In some embodiments, the controller may, based on the operating power of the heating rods during the preset future period, control the heating rods to generate heat throughout a designated operating time period. Similarly, based on the operating power of the fan drive motor during the preset future period, the controller may control the fan drive motor to drive the fan throughout its designated operating time period.

According to some embodiments of the present disclosure, the current temperature data and the energy amount are used to determine the operating parameters, and the energy amount obtained from the solar panel can be rationally distributed.

In some embodiments, the controller is configured to adjust the heating parameters and the fan parameters based on historical temperature data, temperature data, an energy amount, freeze-thaw data, and weather forecast data at the current moment through a prediction model.

The historical temperature data refers to temperature data at a plurality of points in time before the current moment.

The freeze-thaw data refers to historical data related to freeze-thaw. The freeze-thaw data is, for example, historical data related to freeze-thaw before the current moment.

The freeze-thaw data include a historical freezing temperature, a historical thawing temperature, and historical humidity data when freezing occurred for soil at different depths. The historical freezing temperature refers to the lowest temperature at which freezing occurs in the soil at a given depth or location (e.g., the temperature point at which water in the soil begins to freeze). The historical thawing temperature refers to the highest temperature at which thawing occurs in the soil at a given depth or location (e.g., the temperature point at which frozen soil begins to change to liquid water). The historical humidity data refers to the humidity of the soil at the time of freezing. The freeze-thaw data may be determined by a technician performing a manual walk-through of the base.

The weather forecast data refers to weather forecast in the preset future period. The weather forecast data includes temperature, humidity, and light intensity in the preset future period. The weather forecast data may be obtained from a publicly available weather forecast website by a technician or the controller.

The prediction model may be a machine learning model or other models, for example, a deep neural network (DNN) model, or the like.

In some embodiments, the prediction model may include an environmental change prediction layer and a frost heave risk prediction layer. The environmental change prediction layer and the frost heave risk prediction layer may be convolutional neural network (CNN) models, deep neural network (DNN) models, or the like.

In some embodiments, the controller is configured to determine, via the environmental change prediction layer, temperature data at a plurality of moments within the preset future period based on the historical temperature data, the temperature data, the energy amount, and weather forecast data at the current moment, determine, via the frost heave risk prediction layer, a frost heave risk at the plurality of moments within the preset future period based on temperature data, freeze-thaw data, and weather forecast data at the plurality of moments within the preset future period, and adjust the heating parameters and the fan parameters based on the frost heave risk.

The frost heave risk refers to the probability that frost heave will occur. For example, a higher frost heave risk indicates a higher probability of the frost heave occurring in the future.

In some embodiments, the environmental change prediction layer may be obtained by training based on a plurality of first training samples with first labels. For example, a plurality of first training samples with labels may be input into the environmental change prediction layer, a loss function is constructed from the first labels and the results of an initial environmental change prediction layer, and based on the loss function, the initial environmental change prediction layer is iteratively updated by a gradient descent algorithm or another algorithms to update parameters of the initial environmental change prediction layer. The training of the model is completed when preset conditions are satisfied, and a trained environmental change prediction layer is obtained. The preset conditions may be that the loss function converges, the count of iterations reaches a threshold, or the like.

In some embodiments, the first training samples include sample historical temperature data at the first historical time point (i.e., before the first historical time point), sample temperature data, sample energy amount, and sample weather forecast data. The first labels include temperature data of the first training samples at a plurality of moments in a second historical time period. The first historical time point is before the second historical time period. The first training sample is determined based on historical temperature data, temperature data, energy amount, and weather forecast data at the first historical time point. The first labels are determined based on actual temperature data at a plurality of moments of the second historical time period, the first historical time point is before the second historical time period.

In some embodiments, the frost heave risk prediction layer may be obtained by training based on a plurality of second training samples with second labels. The process of training the frost heave risk prediction layer is similar to the process of training the environmental change prediction layer.

In some embodiments, the second training samples include sample temperature data, sample freeze-thaw data, and sample weather forecast data. The second labels include a frost heave risk corresponding to the second training samples. The second training samples may be obtained by obtaining temperature data at a plurality of moments within a plurality of preset historical time periods in historical data of a plurality of different bases, and a corresponding plurality of pieces of historical freeze-thaw data (i.e., freeze-thaw data before the plurality of moments) as well as the weather forecast data within the preset historical time periods.

The second labels are constructed in the following manner. The second training samples are clustered, and for each cluster, a ratio of a count of second training samples corresponding to a plurality of the second training samples within the cluster whose base underwent a frost heave in the preset historical time period to a total count of the second training samples within the cluster as a second label corresponding to each second training sample within the cluster. When the tower offset value of the base is greater than an offset threshold during the preset historical time period, the frost heave is considered to have occurred. At this time, the count of the second training samples for which frost heave has occurred is increased by 1. The offset threshold is preset by the technician. More descriptions regarding the tower offset value may be found hereinabove.

In some embodiments, the controller is configured to boost the operating power of the heating rods by a first preset adjustment amount and the operating power of the fan drive motor by a second preset adjustment amount in response to determining that the frost heave risk greater than a preset risk threshold.

The preset risk threshold, the first preset adjustment amount, and the second preset adjustment amount may be set by a technician based on experience. In some embodiments, the first preset adjustment amount and the second preset adjustment amount are positively correlated to the frost heave risk. That is, the greater the frost heave risk, the greater the first preset adjustment amount and the second preset adjustment amount.

When the frost heave risk is high, the preset adjustment amount is large, which is conducive to preventing the occurrence of frost heave, and minimizing the tower offset value. When the frost heave risk is low (even if it also exceeds the preset risk threshold), the preset adjustment amount is small, which may ensure the effect of preventing frost heave while saving the electric power.

In some embodiments of the present disclosure, when the frost heave risk is high, increasing the operating power of the heating rods and the fan drive motor in advance may help to improve an effect of anti-frost heave.

In some embodiments, an output of the environmental change prediction layer further includes a preset total energy amount from the solar panel in a future time period.

The total energy amount from the solar panel in the preset future period refers to the total amount of electricity that may be provided by the solar panel in the preset future period. Correspondingly, the second label further includes a historical total energy amount of the solar panel corresponding to different bases during the preset historical time period. The historical total energy amount may be obtained through a power record of the battery.

In some embodiments, the equipment installation chamber 51 is further provided with a wind speed sensor 113, the wind speed sensor 113 being provided within the side vent pipe 96 and configured to monitor the wind speed within the side vent pipe 96.

In some embodiments, the controller is further configured to adjust the operating power of the fan drive motor in response to determining that a wind speed at a current moment is greater than a wind speed threshold, and control the fan drive motor to drive the fan for blowing air based on the adjusted operating power.

The wind speed threshold is set by the technician based on experience. In some embodiments, the wind speed threshold is negatively correlated to the frequency of the wind being monitored by the wind speed sensor. The frequency of the wind being monitored by the wind speed sensor refers to the time that the wind speed sensor monitors the wind. For example, the higher the frequency of the wind being monitored by the wind speed sensor, the lower the wind speed threshold.

When the wind speed inside the side vent pipe 96 is higher and the frequency of the wind being monitored is higher, it indicates that there may be a larger natural wind inside the side vent pipe 96 in addition to the fan. At this time, the wind speed threshold may be appropriately lowered, and the effect of anti-frost heave is ensured while saving as much power as possible used by the solar panel at the fan drive motor 93.

In some embodiments, the controller reduces the operating power of the fan drive motor by a third preset adjustment amount. The third preset adjustment amount is set by the technician based on experience.

In some embodiments, the controller is configured to determine the heating parameters and the fan parameters based on the temperature data, the energy amount, and the tower offset value at the current moment, via a second vector database. More descriptions regarding the tower offset value may be found hereinabove.

The second vector database is similar to the first vector database, with the difference that the reference vectors in the second vector database also include a tower offset value corresponding to the historical moment.

In some embodiments, the controller is configured to issue, in response to determining that the total energy amount of the solar panel in the preset future time period and the temperature data at a plurality of moments in the preset time period does not meet a preset warning condition, a power warning, and switch the power supply mode of the internal power-consuming device, and send it to the display terminal for display. More descriptions regarding the total energy amount of the solar panel in the preset time period and the temperature data at the plurality of moments in the preset time period may be found hereinabove.

The preset warning condition refers to a warning condition that is set in advance. The preset warning condition includes that the total energy amount of the solar panel in the preset future time period is greater than a standard power usage corresponding to temperature data at the plurality of moments in the preset time period.

The standard power usage refers to a minimum power usage to prevent freezing and pulling of the soil. The standard power usage may be determined by a first preset table. The first preset table includes temperature data at the plurality of moments in the preset future time period and a corresponding standard electricity consumption. The first preset table may be constructed from historical data. For example, the temperature data at a plurality of moments in a plurality of preset historical time periods is obtained, and an average of the actual electricity consumption in the preset historical time period is designated as the corresponding standard electricity consumption.

The power warning refers to an alert that is related to power. For example, a power warning is to display "solar panel power generation is insufficient" on the display terminal. The display terminal includes a computer display, a touch screen terminal (e.g., cell phones, tablets), embedded display terminals, or the like.

Switching the power supply mode of the internal power-consuming device means accessing the backup power supply (e.g., using external cables to power the internal power-consuming device).

In some embodiments, when the power generation of the solar panel in the preset future time period is not sufficient to realize the effect of anti-frost heave under the temperature data, by switching the power supply mode, the standby power supply is able to supply more power to the heating rods and the fan drive motor, thus the heating rods and the fan drive motor may run at higher power.

In some embodiments, the controller is configured to issue, in response to the tower offset value greater than the offset threshold, a frost heaveing warning, and send the frost heaveing warning to the display terminal for display.

The frost heave warning includes the tower offset value and the alert message. For example, the frost heave warning includes the alert message "freezing and pulling/offsetting of the transmission line tower base".

In some embodiments, the offset threshold is negatively correlated to an average value of humidity in the soil surrounding the transmission line tower base. For example, the greater the average value of humidity of the surrounding soil, the smaller the offset.

The average value of humidity of the surrounding soil may be obtained from historical data statistics. For example, the technician obtains the humidity of the surrounding soil at a plurality of historical moments through inspections and statistically confirms the average value of humidity of the surrounding soil.

In some embodiments, a high soil humidity indicates that the soil contains a large amount of water, which is more prone to frost heaveing phenomena when this water freezes and expands at low winter temperatures. Therefore, when the soil humidity is high, the offset threshold needs to be appropriately lowered to monitor the frost heave phenomenon on time.

Having thus described the basic concepts, it may be rather apparent to those skilled in the art after reading this detailed disclosure that the foregoing detailed disclosure is intended to be presented by way of example only and is not limiting. Although not explicitly stated here, those skilled in the art may make various modifications, improvements, and amendments to the present disclosure. These alterations, improvements, and amendments are intended to be suggested by this disclosure and are within the spirit and scope of the exemplary embodiments of the present disclosure.

Similarly, it should be appreciated that in the foregoing description of embodiments of the present disclosure, various features are sometimes grouped together in a single embodiment, figure, or description thereof for the purpose of streamlining the disclosure aiding in the understanding of one or more of the various embodiments. However, this disclosure does not mean that object of the present disclosure requires more features than the features mentioned in the claims. Rather, claimed subject matter may lie in less than all features of a single foregoing disclosed embodiment.

Each of the patents, patent applications, publications of patent applications, and other material, such as articles, books, specifications, publications, documents, things, and/or the like, referenced herein is hereby incorporated herein by this reference in its entirety for all purposes. History application documents that are inconsistent or conflictive with the contents of the present disclosure are excluded, as well as documents (currently or subsequently appended to the present specification) limiting the broadest scope of the claims of the present disclosure. By way of example, should there be any inconsistency or conflict between the description, definition, and/or the use of a term associated with any of the incorporated material and that associated with the present document, the description, definition, and/or the use of the term in the present document shall prevail.

In closing, it is to be understood that the embodiments of the present disclosure disclosed herein are illustrative of the principles of the embodiments of the present disclosure. Other modifications that may be employed may be within the scope of the present disclosure. Thus, by way of example, but not of limitation, alternative configurations of the embodiments of the present disclosure may be utilized in accordance with the teachings herein. Accordingly, embodiments of the present disclosure are not limited to that precisely as shown and described.

What is claimed is:

1. A transmission line tower base with electrothermal air-blowing anti-frost heave functions for permafrost regions, comprising, a pile foundation cylinder, a cylinder top seat, a cylinder base, a transmission line tower connection frame, a support column inside the pile foundation cylinder, arcuate tubes, heating rods, and a top air-blowing device, wherein the cylinder top seat is fixedly provided at a top of the pile foundation cylinder, and the transmission line tower connection frame is fixedly mounted on the cylinder top seat for connecting to a bottom foot of a transmission line tower body;

the cylinder base is provided at a bottom of the pile foundation cylinder and includes a plurality of threaded drill rod assemblies, and the cylinder base is configured to anchor the cylinder base to a foundation;

the pile foundation cylinder includes a hollow installation cavity, and the support column is embedded in the installation cavity;

two vertical grooves are symmetrically formed on a cavity wall of the installation cavity, two diameter-expanding wing plates, extending outward from an outer wall of a lower portion of the pile foundation cylinder, are symmetrically arranged on the outer wall of the lower portion of the pile foundation cylinder, and the two diameter-expanding wing plates are respectively positioned below the two vertical grooves;

each diameter-expanding wing plate includes an inclined channel, a top of the inclined channel is communicated with a bottom of a corresponding vertical groove of the two vertical grooves, and a plurality of installation through-holes are symmetrically formed on front and rear surfaces of each diameter-expanding wing plate, the arcuate tubes are provided at front and rear surfaces of the two diameter-expanding wing plates through the plurality of installation through-holes to connect the inclined channels of the two diameter-expanding wing plates with the arcuate tubes;

a top portion of the support column includes an equipment installation chamber, and two passageways are symmetrically formed on a wall of the equipment installation chamber, and the two passageways are in one-to-one correspondence with and communicate with the two vertical grooves;

two heating rods are symmetrically connected to an outer wall of the support column through hinge connectors, the two heating rods are respectively inserted into two inclined channels of the pile foundation cylinder, and a cross-section of each heating rod is smaller than a cross-section of each inclined channel and a cross-section of each vertical groove;

the top air-blowing device is arranged at the top of the pile foundation cylinder and includes an outer casing, a fan, and a fan drive motor, wherein the outer casing is fixedly provided at the top of the pile foundation cylinder, the fan and the fan drive motor are located in the outer casing, the fan is connected to the fan drive motor through a connecting shaft, a top cover is provided at a top of the outer casing, a side vent pipe is provided on a side wall of the outer casing, and a filter is mounted at a port of the side vent pipe; wherein the fan directs airflow downward into the two inclined channels through the two passageways and the two vertical grooves, forcing heat from the two heating rods in the two inclined channels to transfer into the arcuate tubes with the airflow, thereby dispersing the heat into surrounding soil to raise temperature of the surrounding soil; and the cylinder top seat and the transmission line tower connection frame are mounted on a wall of the pile foundation cylinder below the equipment installation chamber.

2. The transmission line tower base of claim 1, wherein the pile foundation cylinder is provided into the foundation, and during installation, a foundation hole is excavated in the foundation, the pile foundation cylinder is provided into the hole, and backfilled.

3. The transmission line tower base of claim 1, wherein the cylinder base has an inverted conical shape.

4. The transmission line tower base of claim 1, wherein each threaded drill rod assembly among the plurality of threaded drill rod assemblies includes a threaded sleeve and a threaded drill rod, the threaded sleeve is fixedly provided at the cylinder base, the threaded drill rod is screwed through and provided in the threaded sleeve, and the threaded drill rod is configured to penetrate into the foundation to maintain stability of the pile foundation cylinder.

5. The transmission line tower base of claim 1, wherein a reduced-diameter step is formed at a bottom of the installation cavity to limit a lower installation position of the support column.

6. The transmission line tower base of claim 1, wherein a first cable passage with vertical penetration is formed through the bottom of the pile foundation cylinder;

a second cable passage is axially formed through the support column, with a lower end communicating with the first cable passage;

a third cable passage is axially formed through the cylinder base, with a top communicating with a bottom of the first cable passage; and a temperature sensor is embedded at a bottom of the cylinder base, and a cable of the temperature sensor extends through the third cable passage, the first cable passage, and the second cable passage into the equipment installation chamber.

7. The transmission line tower base of claim 6, wherein a horizontal fourth cable passage is formed in the support column at a position corresponding to a top end of each heating rod, communicating with the second cable passage, cables of the two heating rods extend through the fourth cable passage and the second cable passage into the equipment installation chamber.

8. The transmission line tower base of claim 6, wherein a controller is provided in the equipment installation chamber, electrically connected to the temperature sensor, the two heating rods, and the fan drive motor, and configured to automatically activate the two heating rods and the fan based on temperature data from the temperature sensor.

* * * * *